US009717332B2

(12) United States Patent
Baraldi et al.

(10) Patent No.: US 9,717,332 B2
(45) Date of Patent: Aug. 1, 2017

(54) SEATING SYSTEM AND ARRANGEMENT THEREOF

(71) Applicant: QubicaAMF Worldwide, LLC, Mechanicsville, VA (US)

(72) Inventors: Massimo Baraldi, Bologna (IT); Tommaso Parisi, Bologna (IT)

(73) Assignee: QUBICAAMF WORLDWIDE, LLC, Mechanicsville, VA (US)

( * ) Notice: Subject to any disclaimer, the term of this patent is extended or adjusted under 35 U.S.C. 154(b) by 77 days.

(21) Appl. No.: 14/155,634

(22) Filed: Jan. 15, 2014

(65) Prior Publication Data

US 2015/0196127 A1 Jul. 16, 2015

(51) Int. Cl.

| | |
|---|---|
| ***A47C 1/124*** | (2006.01) |
| ***A47C 7/44*** | (2006.01) |
| ***A47C 11/00*** | (2006.01) |
| ***A47C 15/00*** | (2006.01) |
| ***A47B 83/02*** | (2006.01) |
| ***A47C 7/58*** | (2006.01) |

(52) U.S. Cl.

CPC ..... *A47B 83/02* (2013.01); *A47C 1/124* (2013.01); *A47C 7/445* (2013.01); *A47C 7/58* (2013.01); *A47C 11/005* (2013.01); *A47C 15/002* (2013.01)

(58) Field of Classification Search

CPC ... A47C 11/005; A47C 13/005; A47C 15/002; A47C 1/124; A47C 7/445

USPC ..... 297/248, 249, 242, 188.08

See application file for complete search history.

(56) References Cited

U.S. PATENT DOCUMENTS

| | | | | | |
|---|---|---|---|---|---|
| 2,505,687 | A | * | 4/1950 | Murphy et al. | 297/232 |
| 2,754,891 | A | * | 7/1956 | Barron | A47C 7/42 297/352 |
| D194,974 | S | * | 4/1963 | Kasparian | D6/379 |
| 3,093,410 | A | * | 6/1963 | Wilson | 297/119 |
| 3,127,216 | A | * | 3/1964 | Clouse | 297/134 |
| 3,817,573 | A | * | 6/1974 | Facury | A47C 3/04 108/62 |
| 3,990,741 | A | * | 11/1976 | Snyder et al. | 297/248 |
| 4,662,679 | A | * | 5/1987 | Franck et al. | 297/240 |
| 5,083,838 | A | * | 1/1992 | Maxwell, Jr. | 297/244 |
| 5,292,177 | A | * | 3/1994 | Balderi et al. | 297/232 |
| 5,306,072 | A | * | 4/1994 | Caldwell | 297/232 |
| 5,470,128 | A | * | 11/1995 | Kerkham | 297/232 |
| 5,653,507 | A | * | 8/1997 | Moore | 297/440.14 |
| 5,671,975 | A | * | 9/1997 | Muller | 297/445.1 |
| D427,802 | S | * | 7/2000 | Adler et al. | D6/686 |
| D535,511 | S | * | 1/2007 | Peffley | D6/552 |
| D536,901 | S | * | 2/2007 | Resterhouse et al. | D6/686 |
| 7,267,403 | B2 | * | 9/2007 | Conner | A47C 7/407 297/217.7 |

(Continued)

*Primary Examiner* — Timothy J Brindley

(74) *Attorney, Agent, or Firm* — Andrew M. Calderon; Roberts Mlotkowski Safran Cole & Calderon, P.C.

(57) ABSTRACT

A seating system with an elastically moveable backrest capable of being arranged in different configurations in a settee area of a bowling center is disclosed. The seating system includes a configurable seating arrangement including at least one bench seat configured to accommodate one or more users and a respective number of elastically moveable backrests for each of the one or more users. The configurable seating arrangement further includes a bracket assembly which attaches the respective number of elastically moveable backrests to the at least one bench seat.

22 Claims, 14 Drawing Sheets

(56) References Cited

U.S. PATENT DOCUMENTS

| | | | | |
|---|---|---|---|---|
| D722,237 | S * | 2/2015 | Baraldi | D6/336 |
| D722,445 | S * | 2/2015 | Baraldi et al. | D6/336 |
| 2011/0062754 | A1* | 3/2011 | Mills et al. | 297/188.08 |
| 2013/0187422 | A1* | 7/2013 | Schwinghammer | A47C 7/405 297/239 |

* cited by examiner

SEATING SYSTEM AND ARRANGEMENT THEREOF

BACKGROUND OF THE INVENTION

1. Field of the Invention

The present invention relates to a seating system and arrangement thereof and more particularly to a seating system with an elastically moveable backrest capable of being arranged in different configurations in a settee area of a bowling center.

2. Discussion of Background Information

As shown representatively in FIG. 1, a bowling center 10 typically comprises a plurality of bowling lanes 12 and seating within a settee area 16, e.g., the bowlers' area, amongst other features. By way of more specific illustration, the settee area 16 can be defined as the space between the start of the "approach area" 14, i.e., an area behind the foul line on which the bowler takes his/her steps prior to delivering the ball, to the start of the "concourse area" 18, i.e., the area behind the lane where spectators sit. It is known that the settee area 16 can have different dimensions, with common standard measurements being about 9 feet, 12 feet and 15 feet.

The settee area 16 and the concourse area 18 typically include seating 20. As should be understood, spectators usually sit in the seating 20 in the concourse 18; whereas, bowlers or game participants typically sit in the seating 20 in the settee area 16. The settee area 16 and concourse area 18 can also include tables for food and beverages, etc. Existing bench seating arrangements in the settee area 16 are known to be hard benches made of, for example, fiberglass, wood, plastic and so on. Typically, if a bowling center wants an upholstered seating solution, the center will purchase couches or sofas for the concourse area 18. These couches are typically not placed in the settee area 16 due to durability issues, as well as cost and lack of functionality within the settee area 16. Accordingly, the bowler center does not have any feasible solution to maintain the comfort of the bowler, while they are waiting their turn to participate in the game, e.g., bowl. For these reasons, there is a lack of offerings available for the bowler.

Accordingly, there exists a need in the art to overcome the deficiencies and limitations described hereinabove.

SUMMARY OF THE INVENTION

In an aspect of the invention, a configurable seating arrangement comprises at least one bench seat configured to accommodate one or more users and a respective number of elastically moveable backrests for each of the one or more users. The configurable seating arrangement further comprises a bracket assembly which attaches the respective number of elastically moveable backrests to the at least one bench seat.

In another aspect of the invention, a configurable seating arrangement comprises a single padded bench seat configured to accommodate two or more users and two or more elastically moveable backrests each of which are padded and which respectively accommodate the two or more users. The configurable seating arrangement further comprises two or more bracket assemblies each of which comprise an elastic material and attach the two or more elastically moveable backrests to the single bench seat. The configurable seating arrangement further comprises a leg assembly provided at each end of the single bench seat.

In yet another aspect of the invention, a configurable furniture arrangement comprises a first seating arrangement and a second seating arrangement attached to the first seating arrangement by a table. The first seating arrangement comprises: a single padded bench seat configured to accommodate two or more users; two or more elastically moveable backrests each of which are padded and which respectively accommodate the two or more users; two or more bracket assemblies each of which comprise an elastic material and attach the two or more elastically moveable backrests to the single bench seat; and a leg assembly provided at each end of the single bench seat. The second seating arrangement comprises: a second single padded bench seat configured to accommodate one or more users; one or more elastically moveable backrests each of which are padded and which respectively accommodate the one or more users; one or more bracket assemblies each of which comprise an elastic material and attach the one or more elastically moveable backrests to the second single bench seat; and a leg assembly provided at each end of the second single bench seat.

BRIEF DESCRIPTION OF THE DRAWINGS

These and other innovative aspects, or advantageous features are set out in the appended claims and the technical features and advantages of the invention are apparent from the detailed description which follows of preferred embodiments of it, to be considered purely as non-limiting examples. The description is made with reference to the accompanying drawings, in which:

DETAILED DESCRIPTION OF THE INVENTION

The present invention relates to a seating system and arrangement thereof and more particularly to a seating system with an elastically moveable backrest capable of being arranged in different configurations in a settee area of a bowling center. In embodiments, the seating system of the present invention offers many different seating solutions, particularly within a settee area of a bowling center. It should be understood, though, that the seating system of the present invention can be provided in other locations throughout a facility, e.g., bowling center.

More specifically and advantageously, the seating system of the present invention provides increased comfort to the user by use of an elastically moveable backrest and padded cushioning (e.g., both on the seat and backrest), while also providing the required versatility needed for different settee area dimensions and configurations. In embodiments, for example, multiple elastically moveable backrests can be provided for a single bench configuration, regardless of the number of seating spaces provided on the single bench unit. Also, the seating system of the present invention is configurable with other furniture units. Accordingly, the seating system of the present invention provides the advantage of configurability (e.g., used in different arrangements) with different furniture units, e.g., chairs, stools, tables, ball racks, etc, in different arrangements, as well as different floor space dimensions. In this way, the present invention provides increased versatility for seating solutions in a bowling center.

It is further noted that prior to the present invention existing bench seating arrangements for the settee area have been hard benches, none of which were configurable to different areas in the manner disclosed herein. This means that the present invention is capable increasing the comfort of the game participant, e.g., bowler, with a soft and upholstered seat and backrest, while being cost effective compared to conventional sofas or couches. Accordingly, the seating system of the present invention provides upholstered benches that currently do not exist in the marketplace.

Figure 1:
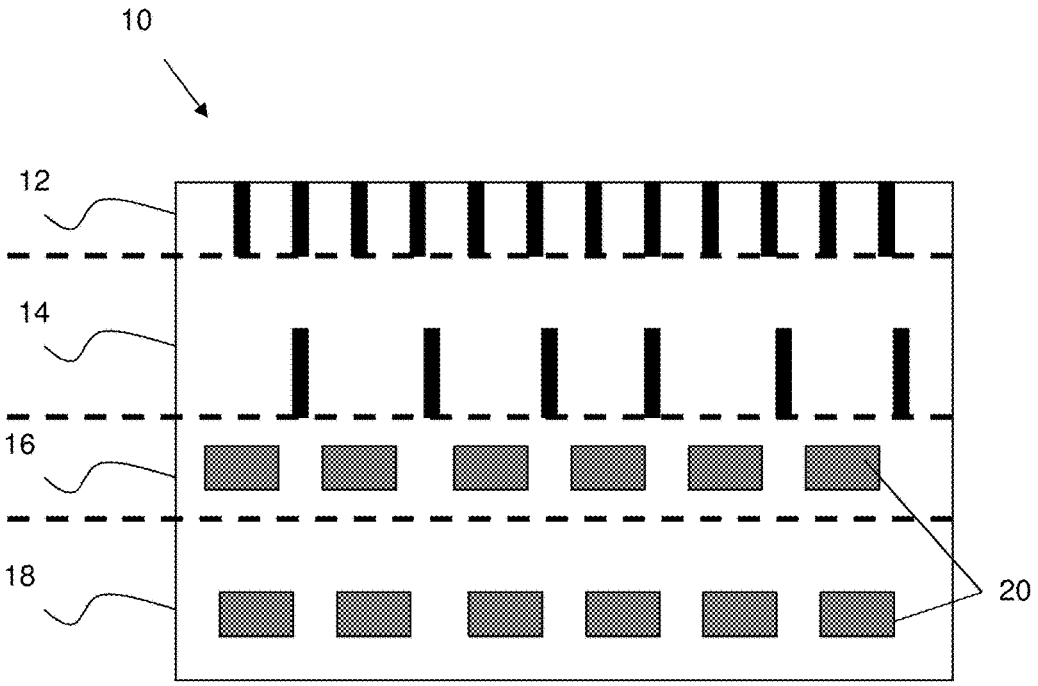
FIG. 1 shows a schematic representation of a bowling center.
Figure 2:
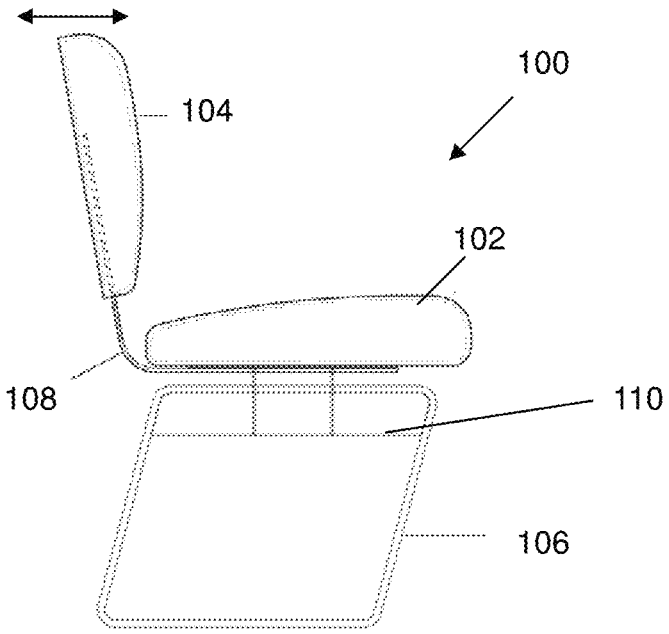
FIG. 2 shows a side view of a seating system in accordance with aspects of the present invention.

FIG. 2 shows a side view of a seating system in accordance with aspects of the present invention. In embodiments, the seating system 100 includes a fully upholstered, seat 102 and backrest 104. The seat 102 and the backrest 104 can be padded and covered with different materials. The padding, for example, can be a foamed material or other known padding material. The material for the seat 102 and the backrest 104 can be, for example, fabric, vinyl, leather or other seating materials known to those of skill in the art.

A leg assembly 106 is attached to a bottom of the seat 102 on opposing ends thereof using known fasteners, e.g., nuts and bolts, screws, etc. The leg assembly 106 can be a box or closed shaped arrangement, as shown in FIG. 2, or other arrangements such as, for example, individual straight or curved legs extending from a bottom of the seat 102 to a flooring surface. As in any of the embodiments, the leg assembly 106 is configured to provide a space under the seat 102 so that players can store their personal bags/objects. Also, in this configuration of a bench, the leg assembly 106 need only be provided on opposing ends of the seat 102 (without need for legs in other locations), thereby reducing material and construction costs as well as increasing storage space under the seat. As described herein, a storage rack 110 can also be provided under the seat 102.

Still referring to FIG. 2, the backrest 104 is attached to the seat 104 by a spring-like bracket assembly 108. By way of non-limiting illustrative example, the bracket assembly 108 can extend from a bottom portion of the seat 102 to a back of the backrest 104, fastened using preferably nuts and bolts; although other fastening mechanisms known to those of skill in the art are also contemplated by the present. In embodiments, the bracket assembly 108 is comprised of elastic material. This elastic material can be, for example, plastic, carbon fiber, metal, metal alloys and/or other materials having an elasticity which allows the bracket assembly 108 to behave in a spring-like manner. That is, the bracket assembly 108 will move slightly backward or become inclined by a certain predetermined distance (depending on the material and its modulus of elasticity) when a user applies a force on the backrest, e.g., rests his/her back of the backrest, while returning to its initial position when the user no longer applies such force onto the backrest, as represented by the arrow in FIG. 2.

In embodiments, the bracket assembly 108 also provides added comfort to the user. For example, the bracket assembly 108 allows the backrest 104 to be slightly inclined when the user is sitting on the seating system 100. Also, the spring-like backrest 104 facilitates or assists the user to the standing position from the seated position. Considering that in the settee area players need to sit and get up often, it is clear that the seating system 100 can represent an additional comfort feature.

Figure 3:
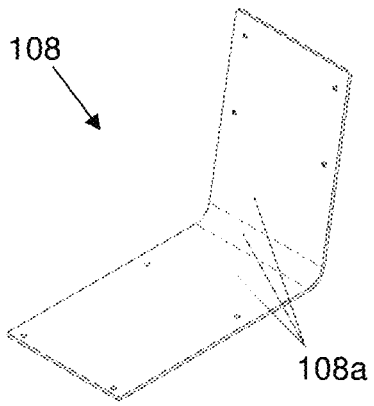
FIG. 3 shows a bracket assembly used in the seating system of the present invention.

FIG. 3 shows the bracket assembly 108 of the present invention. As shown in this representation, the bracket assembly 108 comprises a top and bottom surface with a transitional portion therebetween, all of which are represented at reference numeral 108*a*. The top and bottom surfaces are provided at a predetermined angle with respect to one another. In embodiments, the predetermined angle can be any angle of comfort, e.g., approximately 90° and more preferably about 90° to 110°; although other angles are also contemplated by the present invention.

Figure 4:
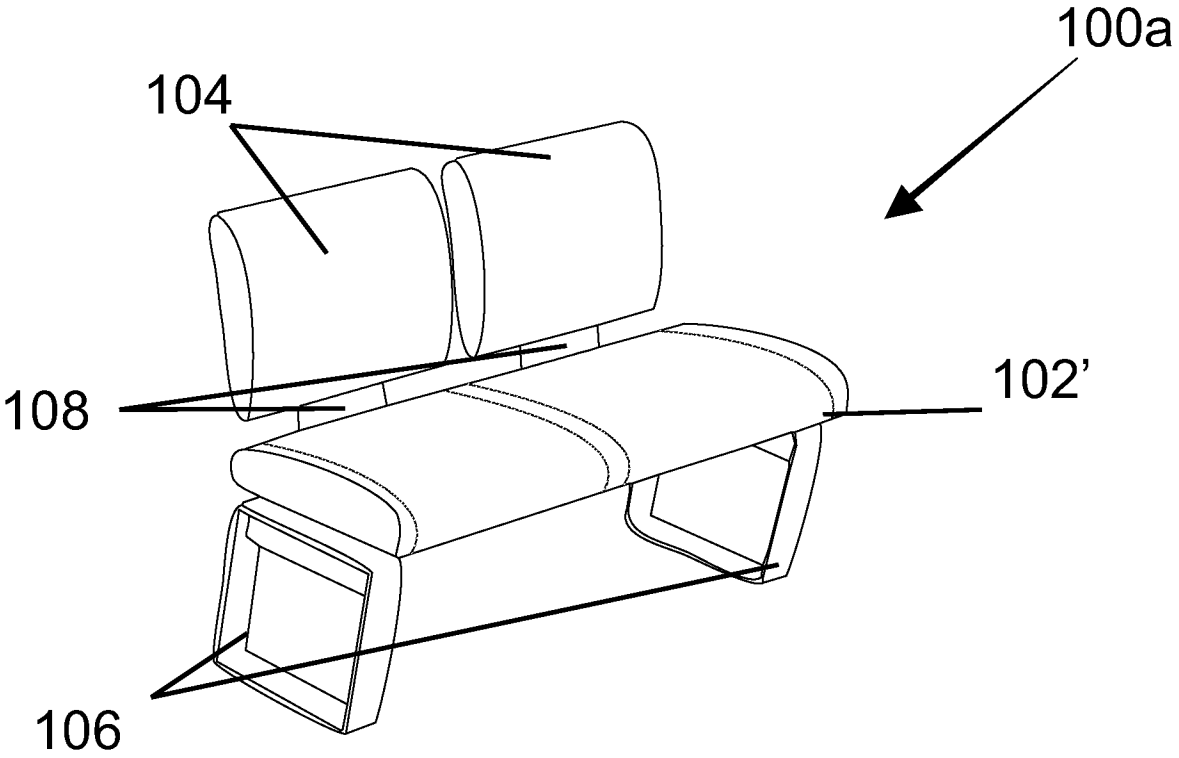
FIG. 4 shows a perspective view of a configuration of the seating system in accordance with additional aspects of the present invention.

FIG. 4 shows a perspective view of a configuration of the seating system in accordance with additional aspects of the present invention. In this configuration, the seating system 100*a* includes a single bench seat 102', which is configured to accommodate two users. In embodiments, the single bench seat 102' is padded and upholstered in order to provide comfort to the users. Two backrests 104 are attached to the single bench seat 102' by two respective bracket assemblies 108. The two backrests 104 are also padded and upholstered, in order to provide comfort to the users. Accordingly, in this configuration, the seating system 100*a* can comfortably accommodate two users, in a single bench configuration with separate backrests.

As the single bench seat 102' of FIG. 4 and other aspects of the present invention are provided in a bench configuration (as described herein), the leg assembly 106 need only be provided on opposing ends of each seat (without need for legs in other locations), thereby reducing material needs and construction costs. This arrangement also increases storage space under the seat, as there is no need for extra legs as is typically provided in conventional bench seat configurations. Moreover, the positioning of the leg assemblies 106 for any of the aspects of the present invention allow for storage space availability under the bench seat without any interference.

Figure 5:
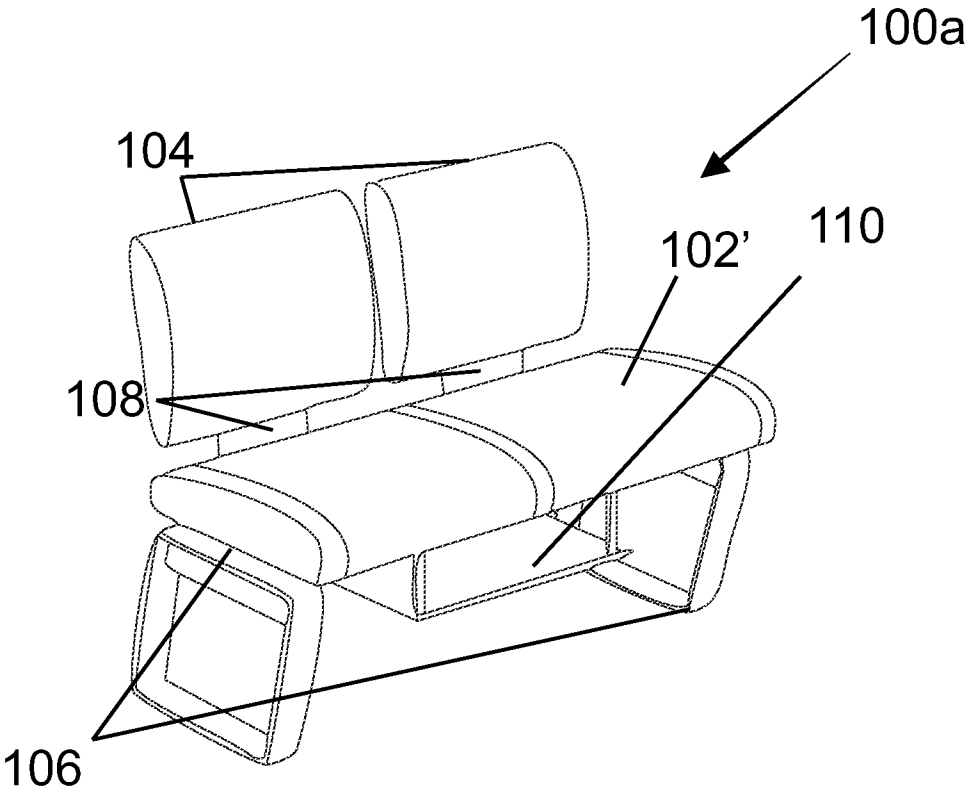
FIG. 5 shows a configuration of the seating system of FIG. 4, with a storage rack.

FIG. 5 shows a configuration of the seating system 100*a* of FIG. 4, with a storage rack 110. In embodiments, the storage rack 110 extends from underneath the single bench seat 102', between the leg assemblies 106. In embodiments, the storage rack 110 can be a shelve system or other system for holding items, e.g., towels, shoes, etc.

Figure 6:
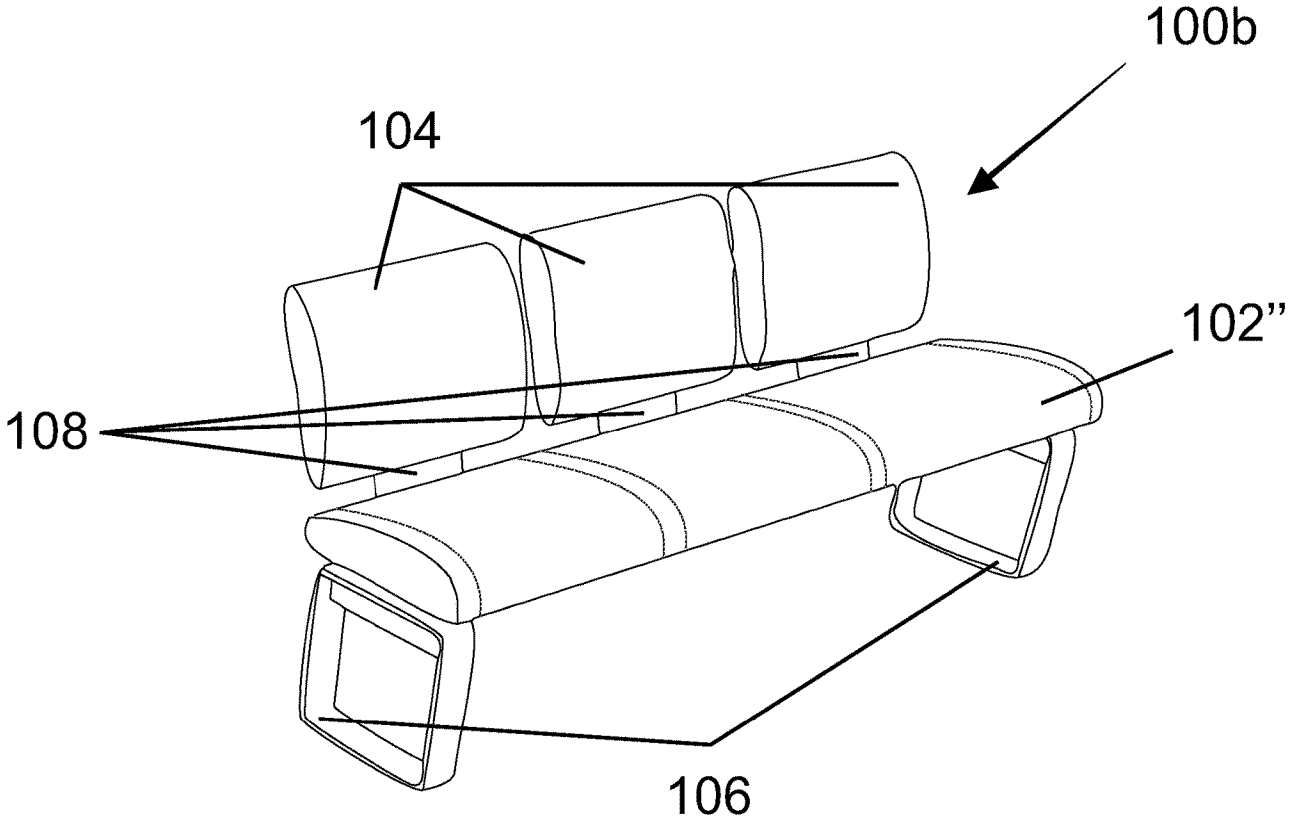
FIG. 6 shows a perspective view of a configuration of the seating system in accordance with additional aspects of the present invention.

FIG. 6 shows a perspective view of a configuration of the seating system in accordance with additional aspects of the present invention. In this configuration, the seating system 100*b* includes a single bench seat 102", which is configured to accommodate three users. In embodiments, the single bench seat 102" is padded and upholstered in order to provide comfort to the users. Three backrests 104 are attached to the single bench seat 102" by three respective bracket assemblies 108. The three backrests 104 are also padded and upholstered, in order to provide comfort to the users. Accordingly, in this configuration, the seating system 100*b* can comfortably accommodate three users, in a single bench configuration with separate backrests.

Figure 7:
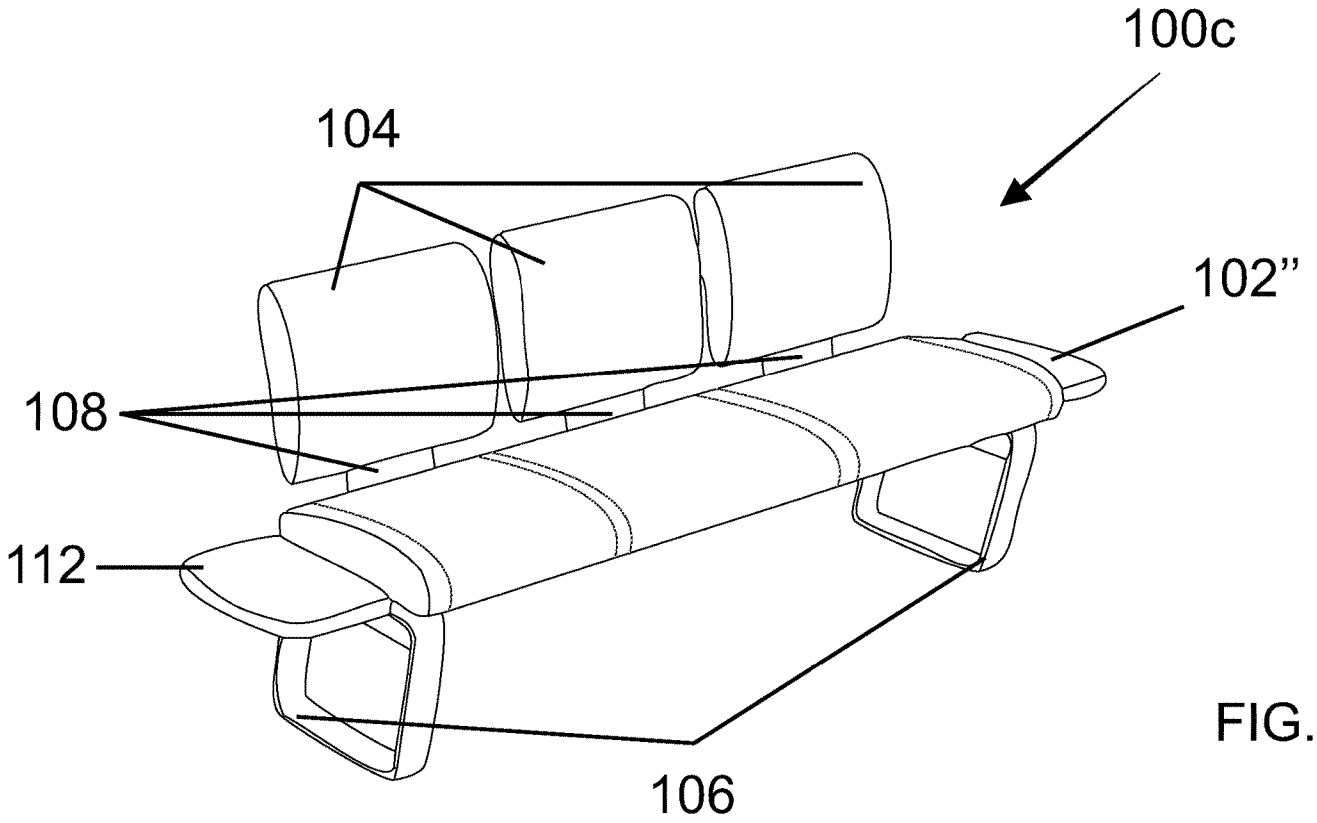
FIG. 7 shows a configuration of the seating system of FIG. 6, with end tables.
Figure 8:
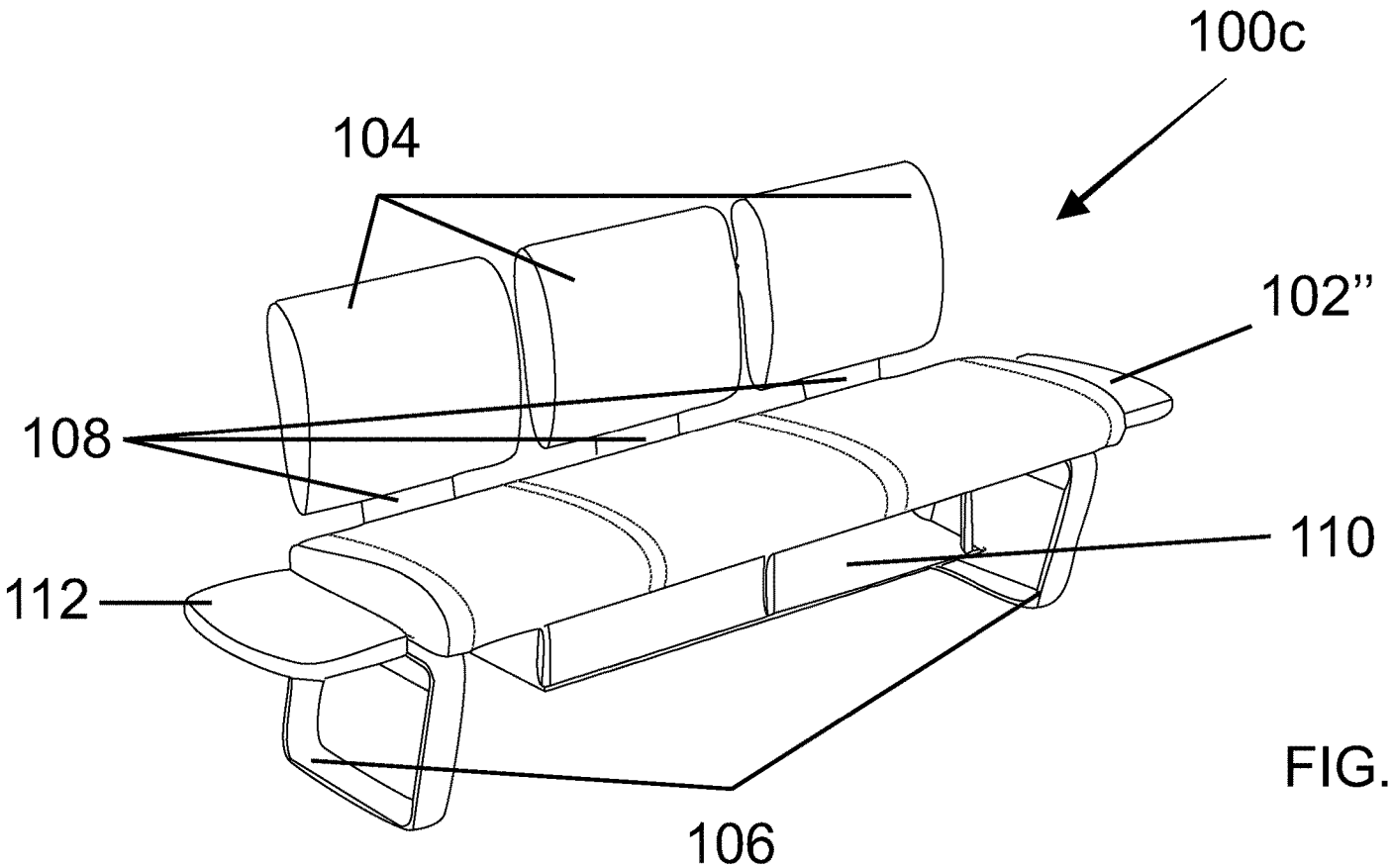
FIGS. 8-11 show perspective views of various configurations of the seating systems in accordance with yet additional aspects of the present invention.

FIG. 7 shows a configuration of the seating system 100*c* of FIG. 6 with end tables 112. The end tables 112 can be provided on one or both ends of the single bench seat 102", depending on the desired configuration. Also, the present invention contemplates the use of the end tables 112 on any bench configuration, e.g., a bench seat that accommodates any number of users. In further embodiments, the end tables 112 can be used in combination with the storage rack 110 of FIG. 5 or FIG. 8, for example. As in other aspects of the invention, the single bench seat 102" and the three backrests 104 are padded and upholstered, in order to provide comfort to the users.

Figure 9:
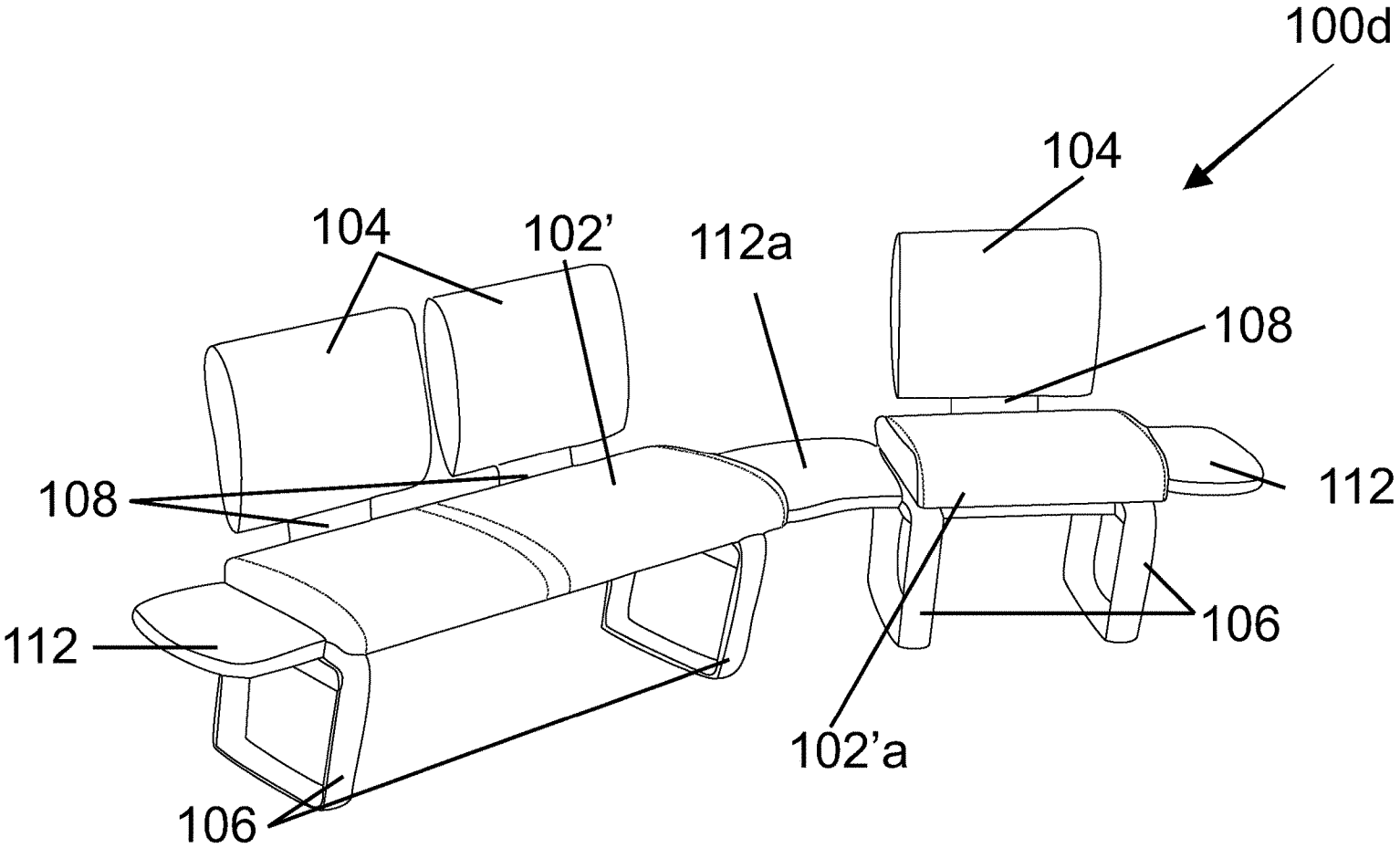

FIG. 9 shows a perspective view of a configuration of the seating system in accordance with additional aspects of the present invention. In this configuration, the seating system 100*d* includes a single bench seat 102' configured to accommodate two users, in addition to a single bench seat 102'*a* configured to accommodate a single user. Similar to the other configurations, the single bench seat 102' includes two backrests 104 attached thereto by two respective bracket assemblies 108; whereas the single bench seat 102'*a* includes a single backrest 104 attached thereto by a single bracket assembly 108. A table 112*a* can be provided between the single bench seat 102' and single bench seat 102'*a* to make an integral seating unit. The table 112*a* can be of different sizes and shapes, e.g., rectangle or angled, depending on the desired configuration of the seating system 100*d*. For example, as shown in FIG. 9, an angled table configuration provides an angled seating configuration, e.g., the single bench seat 102' and single bench seat 102'*a* are provided at an angle with respect to one another, e.g., greater than 0° and less than 180°.

Figure 10:
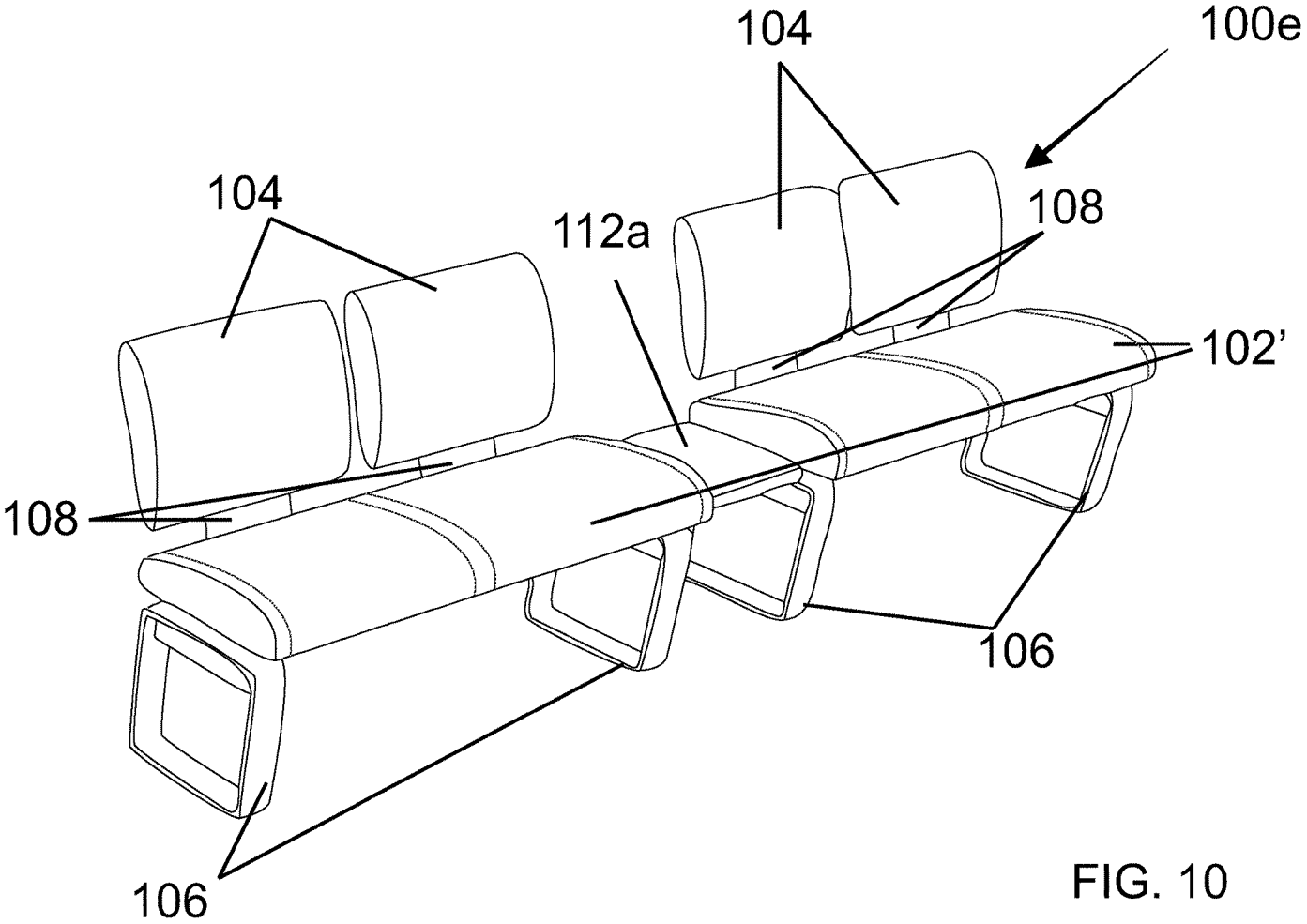

FIG. 10 shows a perspective view of a configuration of the seating system in accordance with additional aspects of the present invention. In this configuration, the seating system 100*e* includes two single bench seats 102' each configured to accommodate two users. Similar to other configurations, the single bench seats 102' each include two backrests 104 attached thereto by two respective bracket assemblies 108. A table 112*a* can be provided between the single bench seats 102' to make an integral seating unit. In this configuration, the table 112*a* is rectangle or square resulting in a straight configuration of the seating configuration. Although not shown in this configuration, an end table can be provided on opposing ends of each single bench seat 102' or any combination thereof. Also, as in the other aspects of the invention, the single bench seats 102' and respective back rests 104 are padded and upholstered in order to provide comfort to the users. Accordingly, in this configuration, the seating system 100*e* can comfortably accommodate three users, in a combination of single bench configurations.

Figure 11:
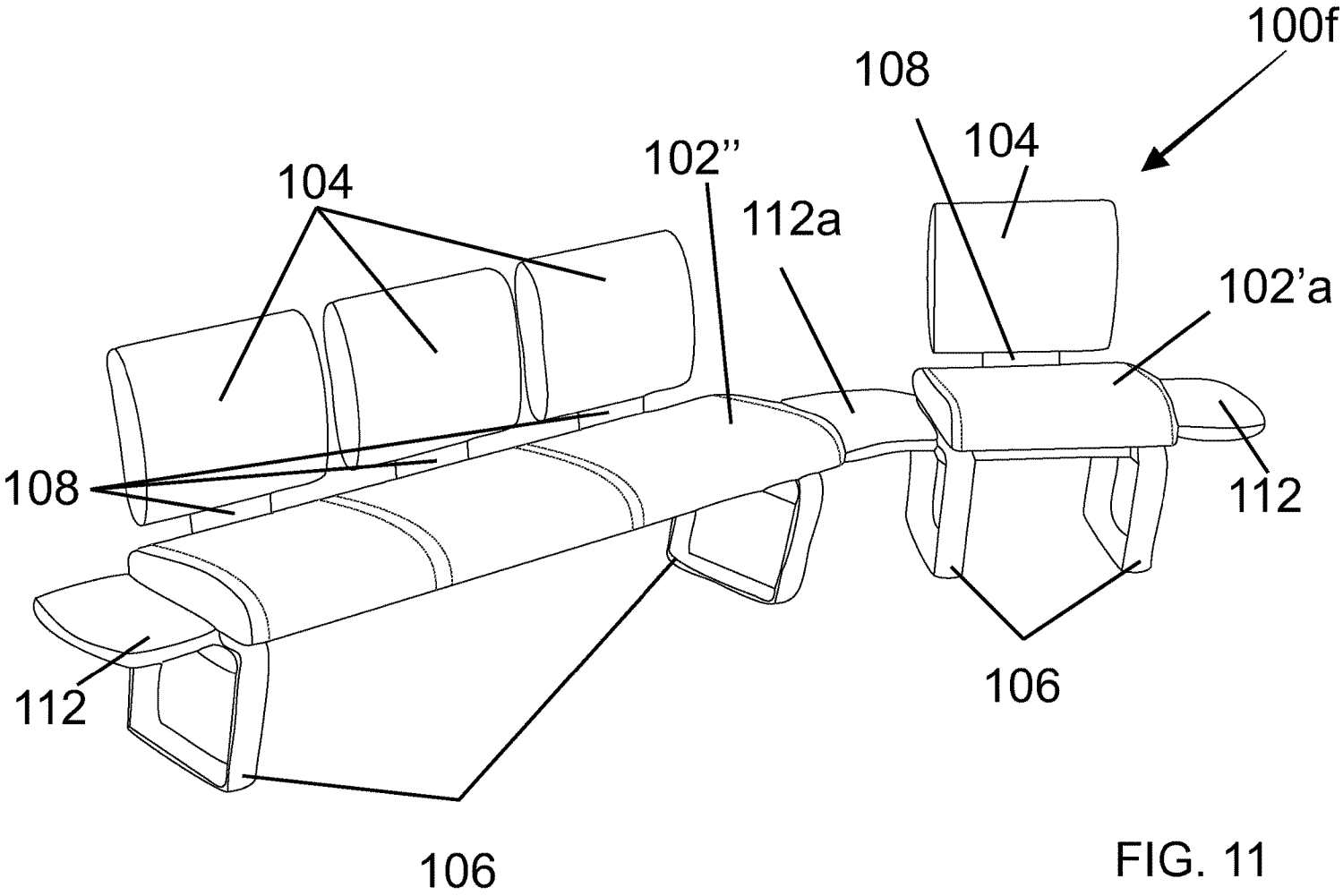

FIG. 11 shows a perspective view of a configuration of the seating system in accordance with additional aspects of the present invention. In this configuration, the seating system 100*f* includes a single bench seat 102" configured to accommodate three users, in addition to a single bench seat 102'*a* configured to accommodate a single user. Similar to other configurations, the single bench seat 102" includes three backrests 104 attached thereto by three respective bracket assemblies 108; whereas the single bench seat 102'*a* includes a single backrest 104 attached thereto by a single bracket assembly 108. A table 112*a* can be provided between the single bench seat 102" and single bench seat 102'*a* to make an integral seating unit. In this configuration, the table 112*a* is an angled table to provide an angled seating configuration; however, the table can also be a rectangular or square table to provide a straight seating configuration. As in other aspects of the invention, the bench seats 102'", 102'*a* and respective back rests 104 are padded and upholstered, in order to provide comfort to the users. Accordingly, in this configuration, the seating system 100*f* can comfortably accommodate four users.

Figure 12:
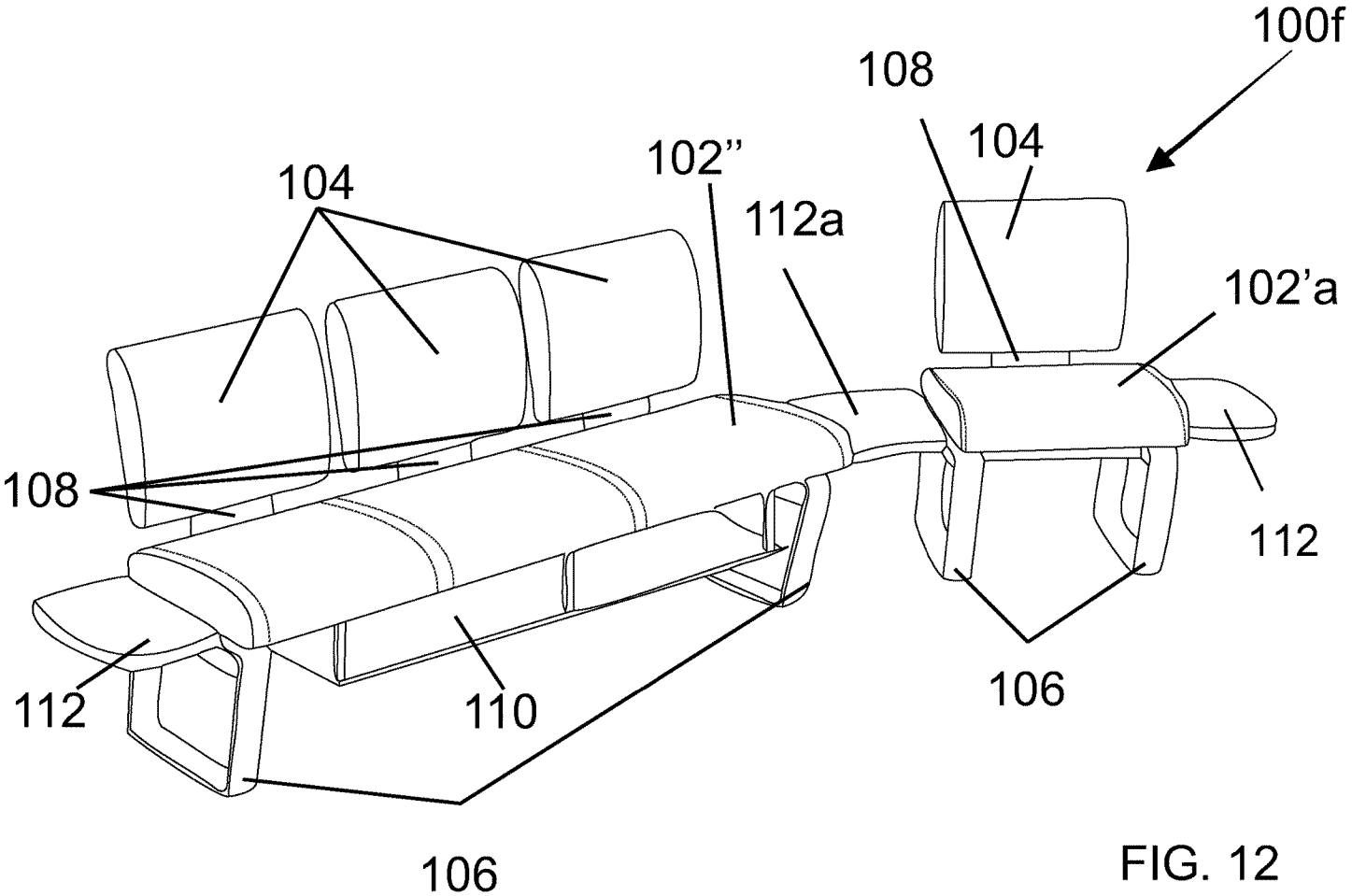
FIG. 12 shows the seating system of FIG. 11, with a storage rack.

FIG. 12 shows the seating system 100*f* of FIG. 11 with a storage rack 110. In embodiments, the storage rack 110 extends from underneath of the single bench seat 102", between the leg assemblies 106. In embodiments, the storage rack 110 can also extend from underneath the single bench seat 102*a*' or any combinations thereof.

Figure 13:
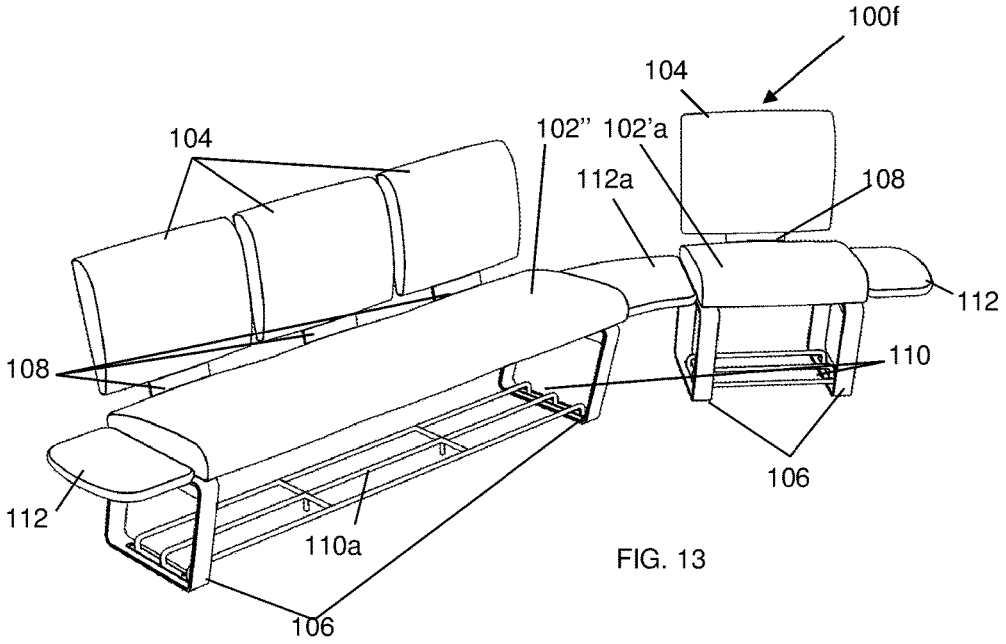
FIG. 13 shows the seating system of FIG. 11, with another type of storage rack.

FIG. 13 shows the seating system 100*f* of FIG. 11 with another storage rack 110. In embodiments, the storage rack 110*a* is provided underneath the single bench seat 102" and single bench seat 102*a*', preferably attached to the leg assembly 106 of each seating arrangement. In embodiments, the storage rack 110 can comprise a plurality of rails 110*a*, attached to the leg assemblies 106. As should be understood by those of ordinary skill in the art, this storage rack 110 can be used with any of the seating arrangements of the present invention, and that the use of storage rack shown in the previous aspects of the present invention are schematic representations which include the representation of storage rack 110.

Figure 14:
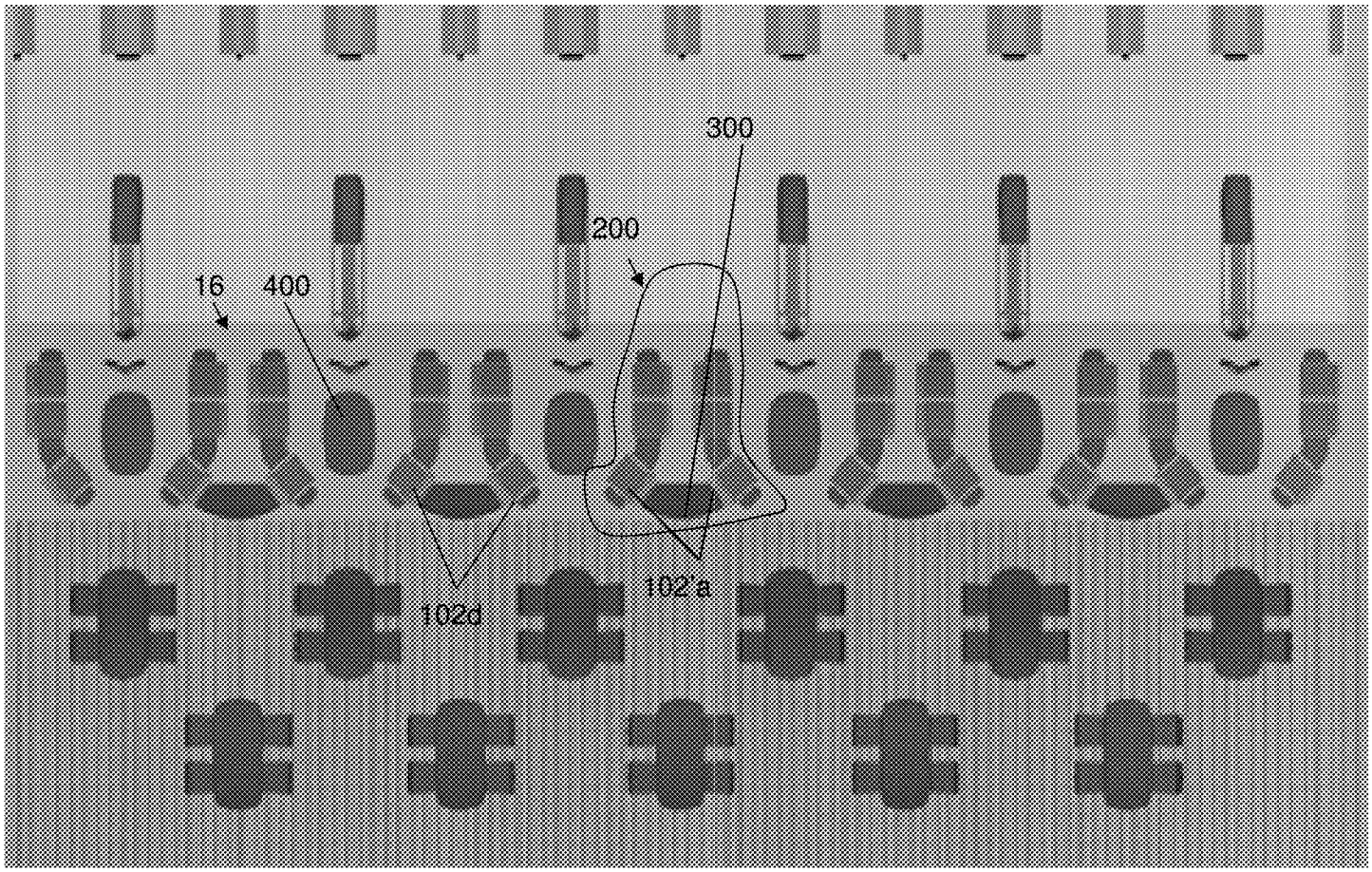
FIGS. 14 and 15 show exemplary layouts of a bowling center, implementing the seating system of the present invention.
Figure 15:
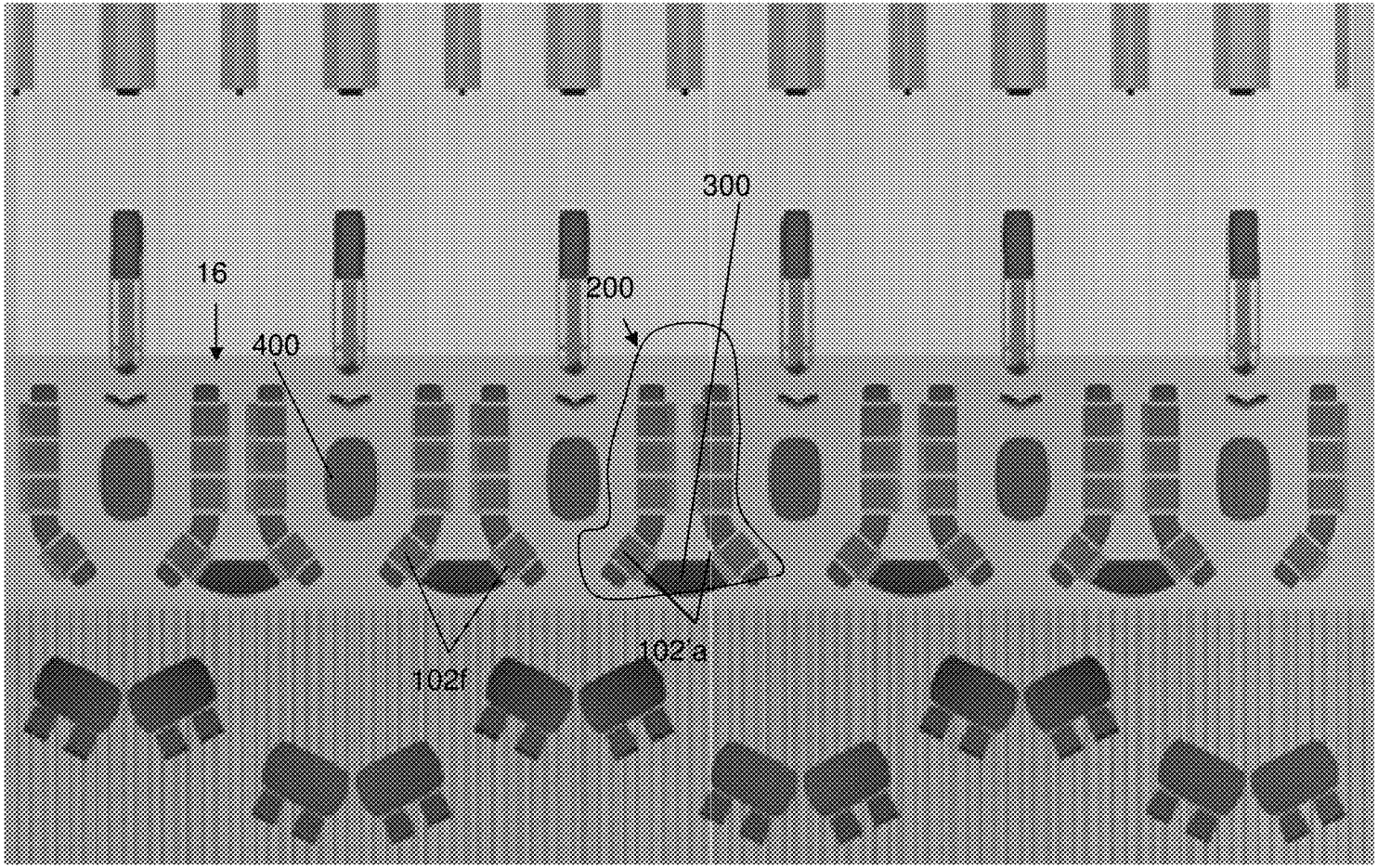

FIGS. 14 and 15 show exemplary layouts of a bowling center, implementing the seating system of the present invention. More particularly, FIG. 14 shows the use of the seating system 100*d* of FIG. 9. In this implementation, the seating system 100*d* is provided within the settee area 16 of the bowling center 10. As shown in this representation, the angled seating arrangement of the seating system 100*d* can be provided such that two of the seating systems 100*d* can be arranged in a back to back configuration, as shown in area 200. In this configuration, the single bench seats 102'*a* are arranged at an angle with respect to one another forming a space therebetween. Advantageously, a ball rack 300 or other furniture unit can be placed between these single bench seats 102'*a*. The seating system 100*d* can also be used with tables 400, as well as other furniture units.

FIG. 15 shows a larger settee area 16, compared to that shown in FIG. 14. As a larger settee area is provided, the bowling center configuration can implement the seating system 100*f* of FIGS. 11-13. As shown in this representation, the angled seating arrangement of the seating system 100*f* can be provided such that two of the seating systems 100*f* can be arranged in a back to back configuration, as shown in area 200. In this configuration, the single bench seats 102'*a* are arranged at an angle with respect to one another forming a space therebetween. Advantageously, a ball rack 300 or other furniture unit can be placed between these single bench seats 102'*a*. The seating system 100*f* can also be used with tables 400, as well as other furniture units.

As should be understood by those of skill in the art, any of the seating configurations of the present invention can be provided in the settee area, depending on the dimensions of the settee area and other furniture units placed therein. In this way, the seating configurations of the present invention can answer to the several different needs of the entertainment bowling centers. That is, depending on the needs of the bowling center, the seating arrangements can be configured to have different number of seats with different shapes, including those discussed above. For example, a single bench system with multiple back rests to accommodate multiple seats with or without a single bench system for a single user is contemplated by the present invention, with or without end tables, storage racks, or other table configurations, etc. In this way, the configurability of the seating system of the present invention permits the bowling center to create many different seating configurations, using in the best way the specific size of the settee area and answering to the specific needs of the center.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A configurable seating arrangement, comprising:

at least one bench seat configured to accommodate one or more users;

a respective number of elastically moveable backrests for each of the one or more users; and at least one bracket assembly comprising a top surface, a bottom surface and a transitional portion connecting the top surface and the bottom surface, wherein the top surface of each bracket assembly is fastened to a respective one of the elastically movable backrests and the bottom surface is fastened to the at least one bench seat; and a storage rack under the at least one bench seat, wherein the at least one bench seat accommodates two or more users and the elastically moveable backrests are two or more backrests attached to the at least one bench seat by a respective number of the at least one bracket assemblies.

2. The configurable seating arrangement of claim 1, wherein:

the bracket assembly comprises an elastic material; and the bracket assembly is attached to a bottom of the least one bench seat and each of the respective number of elastically moveable backrests.

3. The configurable seating arrangement of claim 2, wherein the at least one bench seat and the respective number of elastically moveable backrests are padded and upholstered.

4. The configurable seating arrangement of claim 1, further comprising at least one end table provided at one or both ends of the at least one bench seat.

5. The configurable seating arrangement of claim 1, wherein:

the at least one bench seat is a first bench seat and a second bench seat;

the second seat accommodates one or more users and includes a respective one or more of the elastically moveable backrests attached by a respective one or more of the bracket assemblies; and the first bench seat and the second bench seat form a single seating arrangement connected together by a table.

6. The configurable seating arrangement of claim 5, wherein the table is an angled table such that the first bench seat and the second bench seat form an angled seating arrangement.

7. The configurable seating arrangement of claim 5, wherein the table is a rectangular or square table such that the first bench seat and the second bench seat form a straight seating arrangement.

8. The configurable seating arrangement of claim 5, further comprising end tables provided at an opposing end of one or both of the first bench seat and the second bench seat.

9. The configurable seating arrangement of claim 5, further comprising a storage rack provided under one or both of the first bench seat and the second bench seat.

10. A configurable seating arrangement, comprising:

a single padded bench seat configured to accommodate two or more users;

two or more elastically moveable backrests each of which are padded and which respectively accommodate the two or more users;

two or more bracket assemblies each of which comprise an elastic material and attach the two or more elastically moveable backrests to the single bench seat, wherein each bracket assembly comprises a top surface, a bottom surface and a transitional portion connecting the top surface and the bottom surface, wherein the top surface is fastened to a corresponding one of the elastically movable backrests and the bottom surface is fastened to the single padded bench seat;

a leg assembly provided at each end of the single bench seat; and a storage rack under the single padded bench seat.

11. The configurable seating arrangement of claim 10, wherein the storage rack is attached to the leg assembly provided at each end of the single bench seat.

12. The configurable seating arrangement of claim 10, further comprising at least one end table attached to one or both ends of the single padded bench seat.

13. The configurable seating arrangement of claim 10, further comprising:

a second bench seat which accommodates one or more users and includes a respective number of the elastically moveable backrests attached by a respective number of the bracket assemblies; and the single padded bench seat and the second bench seat form a single seating arrangement connected together by a table.

14. The configurable seating arrangement of claim 13, further comprising end tables provided at an opposing end of one or both of the single padded bench seat and the second bench seat.

15. The configurable seating arrangement of claim 14, further comprising a storage rack provided under one or both of the single padded bench seat and the second bench seat.

16. A configurable furniture arrangement comprising:

a first seating arrangement, comprising:

a single padded bench seat configured to accommodate two or more users;

two or more elastically moveable backrests each of which are padded and which respectively accommodate the two or more users;

two or more bracket assemblies each of which comprise an elastic material and attach the two or more elastically moveable backrests to the single bench seat, wherein each bracket assembly includes a top surface, a bottom surface and a transitional portion connecting the top surface and the bottom surface, wherein the top surface is fastened to a corresponding one of the elastically movable backrests and the bottom surface is fastened to the single padded bench seat; and a leg assembly provided at each end of the single bench seat;

a second seating arrangement attached to the first seating arrangement by a table, the second seating arrangement comprising:

a second single padded bench seat configured to accommodate one or more users;

one or more elastically moveable backrests each of which are padded and which respectively accommodate the one or more users;

one or more bracket assemblies each of which comprise an elastic material and attach the one or more elastically moveable backrests to the second single bench seat, wherein each bracket assembly includes a top surface, a bottom surface and a transitional portion connecting the top surface and the bottom surface, wherein the top surface is fastened to a corresponding one of the elastically movable backrests and the bottom surface is fastened to the second single padded bench seat; and a leg assembly provided at each end of the second single bench seat; and another of the first seating arrangement and the second seating arrangement, positioned back to back with the first seating arrangement and the second seating arrangement, with a furniture unit between back portions of the second seating arrangement and the another second seating arrangement, wherein the furniture unit is a ball rack.

17. The configurable furniture arrangement of claim 16, further comprising one or more end tables provided at ends of one or both of the single padded bench seat and the second single padded bench seat, opposing the table.

18. A configurable furniture arrangement comprising:

a first seating arrangement, comprising:

a single padded bench seat configured to accommodate two or more users;

two or more elastically moveable backrests each of which are padded and which respectively accommodate the two or more users;

two or more bracket assemblies each of which comprise an elastic material and attach the two or more elastically moveable backrests to the single bench seat, wherein each bracket assembly includes a top surface, a bottom surface and a transitional portion connecting the top surface and the bottom surface, wherein the top surface is fastened to a corresponding one of the elastically movable backrests and the bottom surface is fastened to the single padded bench seat; and a leg assembly provided at each end of the single bench seat;

a second seating arrangement attached to the first seating arrangement by a table, the second seating arrangement comprising:

a second single padded bench seat configured to accommodate one or more users;

one or more elastically moveable backrests each of which are padded and which respectively accommodate the one or more users;

one or more bracket assemblies each of which comprise an elastic material and attach the one or more elastically moveable backrests to the second single bench seat, wherein each bracket assembly includes a top surface, a bottom surface and a transitional portion connecting the top surface and the bottom surface, wherein the top surface is fastened to a corresponding one of the elastically movable backrests and the bottom surface is fastened to the second single padded bench seat; and a leg assembly provided at each end of the second single bench seat; and a storage rack under one or both of the single padded bench seat and the second single padded bench seat.

19. The configurable furniture arrangement of claim 16, wherein the leg assembly for both the single padded bench seat and the second single padded bench seat are positioned for storage space availability under the single padded bench seat and the second single padded bench seat without interference.

20. The configurable seating arrangement of claim 1, wherein bracket assembly is a unitary structure.

21. The configurable seating arrangement of claim 20, wherein the bracket assembly has an L-shape with the top surface extending in a substantially vertical direction and the bottom surface extending in a substantially horizontal direction.

22. The configurable seating arrangement according to claim 21, wherein the bracket assembly is configured to allow the top surface to incline relative to the bottom surface when a user reclines against the corresponding backrest.

* * * * *